US010723014B2

(12) United States Patent
Gallegos

(10) Patent No.: US 10,723,014 B2
(45) Date of Patent: Jul. 28, 2020

(54) TOOL HOLDER FOR HOLDING MULTIPLE TOOLS OF DIFFERENT SIZES

(75) Inventor: Robert J. Gallegos, Fremont, CA (US)

(73) Assignee: Wagic, Inc., San Jose, CA (US)

( * ) Notice: Subject to any disclaimer, the term of this patent is extended or adjusted under 35 U.S.C. 154(b) by 85 days.

(21) Appl. No.: 13/472,384

(22) Filed: May 15, 2012

(65) Prior Publication Data

US 2013/0306508 A1 Nov. 21, 2013

(51) Int. Cl.

| | |
|---|---|
| ***B25H 3/00*** | (2006.01) |
| ***B65D 85/20*** | (2006.01) |
| ***B25G 1/08*** | (2006.01) |
| *B65B 15/00* | (2006.01) |

(52) U.S. Cl.

CPC ..... *B25H 3/003* (2013.01); *B65B 15/00* (2013.01)

(58) Field of Classification Search

CPC ..... B65D 85/28; B65B 3/04; B25H 3/025
USPC ..... 206/370, 377, 382, 378; 81/440
See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | LaForge |
| 580,235 | A | 4/1897 | Strum |
| 647,528 | A | 4/1900 | Schmidt |
| 655,007 | A | 7/1900 | Rairigh |
| 696,995 | A | 4/1902 | Moser |
| 763,745 | A | 6/1904 | Gheen |
| 776,761 | A | 12/1904 | Sampson |
| 873,363 | A | 12/1907 | Ross |
| 875,493 | A | 12/1907 | Beard |
| 890,150 | A | 6/1908 | Marble |
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |
| 1,187,542 | A | 6/1916 | Kaas |

(Continued)

FOREIGN PATENT DOCUMENTS

| | | |
|---|---|---|
| CA | 1147176 | 5/1983 |
| CA | 1232781 A | 2/1988 |

(Continued)

OTHER PUBLICATIONS

Wagic Husky 26pc SAE& METRIC Ball-Head Key Set w/ Torque Handle, http://www.bing.com/shopping/wagic-husky-26pc-sae-metric-ball-head-hex-key-set-w-tor . . . , May 10, 2012.

*Primary Examiner* — Anthony D Stashick
*Assistant Examiner* — Raven Collins
(74) *Attorney, Agent, or Firm* — Haverstock & Owens LLP

(57) ABSTRACT

A tool holder for holding one or more tools when not being used. The tool holder comprises one or more tool holder bodies having one or more slots for receiving a tool. In order to couple a tool with the tool holder, a tool holder body is rotated to an open position and the tool is inserted into one of the one or more slots. Then, the tool holder body is rotated back to a closed position. The tool is securely held within the tool holder body and is not removable when the tool holder body is in the closed position. In some embodiments, the tool holder is configured to hold a L-shaped hexagonal or round tool. A plurality of tool holder bodies are able to be coupled together in order to hold multiple tools of different sizes.

19 Claims, 8 Drawing Sheets

(56) References Cited

U.S. PATENT DOCUMENTS

D53,597 S 7/1919 Marcmann
1,398,583 A 11/1921 Bovee
1,425,270 A 8/1922 Morgan
1,500,852 A 7/1924 Shepard
1,502,044 A 7/1924 McCann
1,530,905 A 3/1925 Nance
1,559,097 A 10/1925 Hill
1,753,026 A 4/1930 Rosati
1,825,936 A 10/1931 Bodmer
1,915,245 A 6/1933 Cook
1,944,606 A 1/1934 Little
1,970,409 A 8/1934 Wiedemann
1,973,188 A 9/1934 Verderber
2,236,333 A 3/1941 Cowles
2,332,656 A 10/1943 Mirando
2,346,364 A 4/1944 Dowe
D142,982 S 11/1945 Bloomfield
2,409,613 A 10/1946 Brooks
2,410,971 A 11/1946 Hartley
2,465,152 A 3/1949 Ellison
2,465,619 A 3/1949 Veit
2,475,268 A 7/1949 Wittle
2,485,991 A 10/1949 Stowell
D156,677 S 12/1949 Smith
D157,154 S 2/1950 Horton
2,509,507 A 5/1950 Kane
2,512,967 A 6/1950 Quiron
2,530,024 A 11/1950 Moody
2,532,636 A 12/1950 Minnich
2,569,069 A 9/1951 Motel
2,590,307 A 3/1952 Gibson
2,593,828 A 4/1952 Arey
2,604,211 A 7/1952 Steine
2,701,052 A * 2/1955 Martel ..... 206/377
D175,056 S 6/1955 Wilson
2,715,028 A 8/1955 Dossie
2,719,042 A 9/1955 Epsy
2,726,091 A 12/1955 Topar
2,776,589 A 1/1957 Gregory
2,778,396 A 1/1957 Swain
2,786,380 A 3/1957 Rolland
D179,979 S 4/1957 Noga
2,797,599 A 7/1957 McGarvie
2,800,816 A 7/1957 Tasciotti
2,804,970 A 9/1957 Kuc et al.
2,810,472 A 10/1957 Midkiff
2,821,403 A 1/1958 Bernard
2,836,210 A 5/1958 Garofalo
2,842,020 A 7/1958 Traquinio
2,844,244 A 7/1958 Hanson
2,851,915 A 9/1958 Martinez
2,854,741 A 10/1958 Cholger
2,878,701 A 3/1959 Weersma
2,977,824 A 4/1961 Rueb
3,023,054 A 2/1962 Shigekuni
3,061,927 A 11/1962 Von Frankenberg Und Ludwingdorf
3,113,479 A 12/1963 Swingle
3,156,143 A 11/1964 Wolfe
3,222,959 A 12/1965 Clark
3,255,792 A 6/1966 Beck
3,257,991 A 6/1966 Mosch
D205,745 S 9/1966 Namfeldt
3,342,229 A 9/1967 Janes
3,343,434 A 9/1967 Schroeder
3,370,696 A 2/1968 Groe
3,424,039 A 1/1969 Scott
3,592,086 A 7/1971 Derwin
3,654,975 A 4/1972 Ballsmith et al.
3,667,518 A 6/1972 Stillwagon, Jr.
3,766,811 A 10/1973 Callahan
3,802,286 A 4/1974 Winklofer et al.
3,863,693 A 2/1975 Carniker
3,943,801 A 3/1976 Yates
3,958,469 A 5/1976 Meese
3,997,053 A 12/1976 Bondhus
4,000,767 A 1/1977 Geng
4,043,230 A 8/1977 Scrivens
4,124,915 A 11/1978 Schlicher
4,154,125 A 5/1979 Frank
4,196,761 A 4/1980 Royer
4,227,430 A 10/1980 Jameson et al.
4,235,269 A 11/1980 Kraus
4,238,862 A 12/1980 Leatherman
4,241,773 A 12/1980 Personnat
4,302,990 A 12/1981 Chrichton et al.
4,308,770 A 1/1982 MacDonald
4,310,094 A 1/1982 Hotchkiss
4,327,790 A 5/1982 Stevens et al.
4,384,499 A 5/1983 Shockley
D270,024 S 8/1983 Strasser
4,424,728 A 1/1984 MacDonald
4,440,048 A 4/1984 Stevens
4,448,097 A 5/1984 Rocca
4,469,109 A 9/1984 Mehl
4,476,751 A 10/1984 Mishima
4,525,889 A 7/1985 Dunau
4,542,667 A 9/1985 Jang
D284,810 S 7/1986 Kelemen, Sr.
4,598,822 A 7/1986 Hemmings
4,640,155 A 2/1987 Condon
4,667,822 A 5/1987 Coopmans
4,699,020 A 10/1987 Bush et al.
4,699,030 A * 10/1987 Yang ..... 81/440
4,703,673 A 11/1987 Allen
4,711,353 A 12/1987 Rozmestor
4,716,795 A 1/1988 Corona et al.
4,716,796 A 1/1988 Corona et al.
4,767,006 A 8/1988 Wasem
4,783,867 A 11/1988 Tsao
4,787,276 A 11/1988 Condon
4,819,523 A 4/1989 Souza
4,819,800 A 4/1989 Wilson
4,820,090 A 4/1989 Chen
4,815,346 A 5/1989 Littlehorn
D302,102 S 7/1989 Amagaya
4,882,841 A 11/1989 Margolis
4,922,569 A 5/1990 Brinker et al.
4,926,721 A 5/1990 Hsiao
D308,462 S 6/1990 Komatsu
4,934,223 A 6/1990 Wong
D310,770 S 9/1990 Zamarripa
D311,124 S 10/1990 Learney
4,960,016 A 10/1990 Seals
4,974,477 A 12/1990 Anderson
4,979,407 A 12/1990 Hernandez et al.
5,029,707 A 7/1991 Feng
5,036,975 A 8/1991 Chow
5,042,658 A 8/1991 Tiramani et al.
5,062,173 A 11/1991 Collins et al.
5,063,796 A 11/1991 Gennep
5,065,487 A 11/1991 Yother
5,086,674 A 2/1992 Her
5,146,815 A 9/1992 Scott
5,147,038 A 9/1992 Pergeau
D333,769 S 3/1993 Jureckson
D334,516 S 4/1993 Tsunoda
D339,048 S 9/1993 Baum
5,251,352 A * 10/1993 Cullison ..... 7/105
5,263,389 A 11/1993 Frazell et al.
5,265,504 A 11/1993 Fruhm
D342,433 S 12/1993 Sorenson
5,271,300 A 12/1993 Zurbuchen et al.
D343,106 S 1/1994 Eklind et al.
5,295,422 A 3/1994 Chow
5,320,004 A 6/1994 Hsiao
5,329,834 A 7/1994 Wong
5,394,984 A 3/1995 Aiba
5,416,940 A 5/1995 Bandera
D359,671 S 6/1995 Acosta
5,421,225 A 6/1995 Chen
5,450,774 A 9/1995 Chang
5,450,775 A 9/1995 Kozak
5,461,950 A 10/1995 Iwinski

(56) References Cited

U.S. PATENT DOCUMENTS

D365,681 S 1/1996 Chow
5,495,942 A 3/1996 Ishak
5,499,560 A 3/1996 Aeschliman
5,499,562 A 3/1996 Feng
5,505,316 A 4/1996 Lee
5,515,969 A 5/1996 Schonenbach
5,517,885 A 5/1996 Feng
5,480,166 A 6/1996 Milsop
5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
5,630,342 A 5/1997 Owoc
D380,131 S 6/1997 Sung
D382,190 S 8/1997 Blackston et al.
5,653,525 A 8/1997 Park
D383,048 S 9/1997 Sorenson et al.
5,662,013 A 9/1997 Lin
D385,172 S 10/1997 Bramsiepe et al.
D386,955 S 12/1997 Jones et al.
5,692,656 A 12/1997 Dembicks
D388,609 S 1/1998 Chan
5,711,042 A 1/1998 Chuang
5,711,194 A 1/1998 Anderson et al.
D394,792 S 6/1998 Bourque
D394,794 S 6/1998 Vasudeva
5,758,870 A 6/1998 Weaver
5,765,247 A 6/1998 Seber
5,765,454 A 6/1998 Barbulescu et al.
5,768,960 A 6/1998 Archuleta
5,791,211 A 8/1998 Bondhus et al.
5,802,936 A 9/1998 Liu
5,803,584 A 9/1998 Chung
5,816,401 A * 10/1998 Vasudeva ..... B25H 3/003 206/377
5,820,288 A 10/1998 Cole
5,822,830 A 10/1998 Lin
D400,775 S 11/1998 Hsu
5,855,274 A 1/1999 Piao
D405,335 S 2/1999 Lin
5,911,799 A 6/1999 Johnson et al.
5,916,277 A 6/1999 Dallas
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,625 A 11/1999 Loiselle
5,992,626 A 11/1999 Anderson
D420,885 S 2/2000 Lin
6,032,332 A 3/2000 Lin
6,032,796 A * 3/2000 Hopper ..... B25G 1/005 206/377
1,337,769 A 4/2000 Hemming
6,044,973 A 4/2000 Vasudeva
6,050,409 A 4/2000 Delbeck
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A 7/2000 Liao
6,092,656 A 7/2000 Ernst
6,095,018 A 8/2000 Schuster
6,105,767 A 8/2000 Vasudeva
6,119,560 A 9/2000 Anderson et al.
6,128,981 A 10/2000 Bondhus et al.
6,131,740 A 10/2000 Huang
D433,613 S 11/2000 Jallin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,209,425 B1 4/2001 Hu
6,233,769 B1 5/2001 Seber et al.
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
D448,267 S 9/2001 Jean et al.
6,289,768 B1 9/2001 Anderson et al.
6,308,599 B1 10/2001 Fu-Hui
6,311,587 B1 11/2001 Johnson et al.
6,314,600 B1 11/2001 Cachot
6,314,838 B2 11/2001 Wall
6,315,121 B1 * 11/2001 Hansen ..... B25H 3/04 206/376
6,318,218 B1 11/2001 Anderson et al.
6,332,381 B1 12/2001 Vasudeva
6,345,557 B1 2/2002 Kuo
D454,766 S 3/2002 Lin
6,352,010 B1 3/2002 Giarritta et al.
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wall
6,401,576 B1 6/2002 Wu
6,401,923 B1 6/2002 Huang
6,405,620 B2 6/2002 Liao
D459,967 S 7/2002 Johnson et al.
D461,311 S 8/2002 Gharib
D462,002 S 8/2002 Jean et al.
6,427,564 B1 8/2002 Nelson
6,490,954 B2 12/2002 Johnson et al.
6,510,766 B1 1/2003 Lin
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 * 7/2003 Cunningham ..... 81/177.4
6,601,481 B2 8/2003 Chuang
6,606,925 B1 8/2003 Gmeilbauer
D479,963 S 9/2003 Chang
6,634,502 B1 10/2003 Yu
6,640,675 B1 11/2003 Chuang
6,675,678 B2 1/2004 Liu
6,698,318 B2 3/2004 Peters
6,701,813 B2 3/2004 Hu
6,709,196 B1 3/2004 Medendorp
6,739,224 B1 5/2004 Wershe
6,751,819 B2 6/2004 Chuang
6,751,820 B1 6/2004 Wu
6,752,046 B1 6/2004 Lee
6,758,350 B2 7/2004 Lin
6,763,744 B2 7/2004 Johsnon et al.
D494,438 S 8/2004 Flakenstein et al.
6,799,490 B1 10/2004 Chu
6,827,210 B2 12/2004 Chen
6,863,471 B2 3/2005 Medendorp
6,877,186 B2 4/2005 Shiao
6,896,136 B2 5/2005 Hu
6,898,998 B2 5/2005 Shyu
6,901,826 B2 6/2005 Huang

(56) References Cited

U.S. PATENT DOCUMENTS 6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,935,212 B2 8/2005 Wadsworth
6,941,843 B2 9/2005 Johnson et al.
6,948,406 B1 9/2005 Li
6,968,758 B2 11/2005 Lin
6,971,291 B2 12/2005 An
6,988,616 B2 1/2006 Chen
D517,391 S 3/2006 Leins
7,028,593 B1 4/2006 Lin et al.
7,047,847 B2 5/2006 Chuang
7,051,626 B1 5/2006 Chen
7,051,629 B2 5/2006 Huang
D523,637 S 6/2006 Chang
7,073,418 B2 7/2006 Kuo
7,080,582 B2 7/2006 Karle
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al.
7,143,669 B2 12/2006 Hu
7,150,208 B2 12/2006 Debley
7,155,998 B1 1/2007 Shyu
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,185,565 B1 3/2007 Hu
7,216,569 B2 5/2007 Abdelgany
7,237,463 B1 7/2007 Lee
D548,464 S 8/2007 Lin
D549,069 S 8/2007 Lin et al.
7,281,454 B2 10/2007 Johnson et al.
7,284,466 B1 10/2007 Ho
7,287,450 B1 10/2007 Liao
D557,099 S 12/2007 Lin
7,305,908 B2 12/2007 Chi
7,406,896 B2 8/2008 Rivera
7,409,894 B1 8/2008 Valentine
7,415,745 B2 8/2008 Rivera
7,467,574 B1 12/2008 Lin
7,467,575 B2 12/2008 Lai
7,565,852 B2 7/2009 Yu
7,571,517 B2 8/2009 Smith et al.
7,600,640 B2 10/2009 Hallee et al.
D604,509 S 11/2009 Andrews
7,698,972 B2 4/2010 Hi
7,743,685 B2 6/2010 Chang
D622,125 S 8/2010 Robinson
D623,037 S 9/2010 Johnson et al.
7,788,996 B2 * 9/2010 Johnson et al. ..... 81/177.4
7,810,415 B2 10/2010 Adamany et al.
7,815,058 B2 10/2010 Cheng
7,836,534 B2 11/2010 Simmons
7,846,203 B2 * 12/2010 Cribier ..... 623/2.11
7,946,203 B2 5/2011 Johnson et al.
8,011,277 B2 9/2011 Johnso et al.
8,015,642 B1 9/2011 Oakley
8,033,200 B2 10/2011 Johnson et al.
D650,257 S 12/2011 Royes et al.
8,336,428 B2 12/2012 Johnson et al.
8,359,954 B2 1/2013 Johnson et al.
8,468,916 B2 6/2013 Johnson et al.
8,613,121 B1 12/2013 White
8,621,963 B2 1/2014 Johnson et al.
8,640,574 B2 2/2014 Johnson et al.
8,757,033 B2 6/2014 Johnson
8,875,601 B2 11/2014 Johnson et al.
8,925,429 B2 1/2015 Johnson et al.
9,144,801 B2 9/2015 Johnson
9,604,349 B2 3/2017 Johnson
2001/0005576 A1 6/2001 Roger et al.
2001/0012754 A1 8/2001 Anderson
2001/0045145 A1 11/2001 Legg
2003/0000902 A1 1/2003 Keis et al.
2003/0047474 A1 3/2003 Dahlson
2003/0126957 A1 7/2003 Huang
2003/0136234 A1 7/2003 Cunningham
2003/0188610 A1 10/2003 Lin
2003/0226428 A1 12/2003 Liu
2004/0050218 A1 3/2004 Napoli
2004/0079622 A1 4/2004 Wang
2004/0173061 A1 9/2004 Liou
2004/0262344 A1 12/2004 White
2005/0011318 A1 1/2005 Tsai
2005/0199108 A1 9/2005 Jheng
2005/0211587 A1 9/2005 Chen
2005/0229752 A1 10/2005 Nickipuck
2005/0245900 A1 11/2005 Ash
2005/0247587 A1 11/2005 Holland-Letz
2005/0268752 A1 12/2005 Johnson et al.
2005/0268754 A1 12/2005 Fa
2005/0284267 A1 12/2005 Liao et al.
2006/0042428 A1 3/2006 Chuang
2006/0101955 A1 5/2006 Chang
2006/0118500 A1 6/2006 Chen
2006/0150784 A1 7/2006 Hsieh
2006/0213059 A1 9/2006 Eggert
2006/0254396 A1 11/2006 Hu
2006/0288531 A1 12/2006 Hu
2006/0288823 A1 12/2006 Schepman
2007/0007222 A1 1/2007 Kao
2007/0023306 A1 * 2/2007 Lai ..... 206/372
2007/0044598 A1 3/2007 Frohm et al.
2007/0056117 A1 3/2007 Gardiner et al.
2007/0056872 A1 3/2007 Begim
2007/0062831 A1 3/2007 Chen
2007/0084740 A1 4/2007 Malek
2007/0141885 A1 6/2007 Chen
2007/0151402 A1 7/2007 Schneerman et al.
2007/0186731 A1 * 8/2007 Schnarr et al. ..... 81/177.4
2007/0221017 A1 9/2007 Heaven
2007/0228672 A1 10/2007 Huang
2007/0235360 A1 * 10/2007 Lin ..... B25H 3/003
206/373
2007/0245862 A1 10/2007 Gonzalez et al.
2007/0295171 A1 12/2007 Johnson et al.
2008/0011634 A1 * 1/2008 Lin ..... B25H 3/003
206/372
2008/0128370 A1 6/2008 Shih
2008/0148909 A1 6/2008 Lai
2008/0156754 A1 7/2008 Cheng
2008/0164171 A1 * 7/2008 Meng ..... B25H 3/003
206/377
2008/0190249 A1 8/2008 Yu
2008/0202963 A1 8/2008 Liao
2008/0223179 A1 9/2008 Nash et al.
2008/0251402 A1 10/2008 Chiu
2008/0256816 A1 10/2008 Consentino
2008/0271573 A1 11/2008 Lown et al.
2008/0295657 A1 12/2008 Cluthe
2009/0107303 A1 4/2009 Steinweg et al.
2009/0183608 A1 7/2009 Johnson et al.
2009/0183609 A1 7/2009 Johnson et al.
2009/0241740 A1 10/2009 Heagerty
2010/0230312 A1 * 9/2010 Sorrentino ..... B65D 21/0202
206/369
2010/0258465 A1 10/2010 Gomas
2011/0000024 A1 1/2011 Johnson et al.
2011/0094910 A1 4/2011 Fleury et al.
2012/0012485 A1 * 1/2012 Wang ..... 206/377
2013/0112635 A1 5/2013 Tsukaguchi
2013/0228484 A1 9/2013 Yang
2013/0228539 A1 9/2013 Lin
2013/0256168 A1 * 10/2013 Poillot ..... B25H 3/00
206/372

(56) References Cited

U.S. PATENT DOCUMENTS

| | | | |
|---|---|---|---|
| 2013/0306508 | A1 | 11/2013 | Gallegos |
| 2014/0091118 | A1 | 4/2014 | Hsiao |
| 2015/0001113 | A1 | 1/2015 | Hsiao |

FOREIGN PATENT DOCUMENTS

| | | | | | |
|---|---|---|---|---|---|
| CN | 2628230 | Y | | 7/2004 | |
| DE | 464002 | | | 8/1928 | |
| DE | 2035793 | B1 | | 3/1972 | |
| DE | 2453480 | A1 | | 5/1976 | |
| DE | 3744176 | A1 | | 8/1988 | |
| DE | 102004011892 | | | 1/2005 | |
| DE | 202004013404 | U1 | | 3/2005 | |
| DE | 20 2007 003841 | U1 | | 9/2007 | |
| EP | 856223 | | | 12/1960 | |
| EP | 503559 | A1 | | 9/1992 | |
| EP | 618046 | A1 | | 10/1994 | |
| EP | 01693163 | | | 2/2006 | |
| EP | 01777042 | | | 4/2007 | |
| FR | 787512 | | | 9/1935 | |
| FR | 20120000964 | | * | 3/2012 | ..... B25H 15/008 |
| JP | 55045442 | U | | 3/1980 | |
| JP | 57-13165 | | | 1/1982 | |
| JP | 61136778 | | | 6/1986 | |
| JP | 3-47775 | | | 5/1991 | |
| JP | 03103162 | | | 10/1991 | |
| JP | 4-29368 | | | 3/1992 | |
| JP | 5-31882 | | | 4/1993 | |
| JP | 08505812 | | | 6/1996 | |
| TW | I236402 | | | 7/2005 | |
| TW | M284496 | | | 1/2006 | |
| TW | M284500 | | | 1/2006 | |
| TW | M296765 | | | 9/2006 | |
| TW | I270445 | | | 1/2007 | |
| WO | 83/01406 | | | 4/1983 | |
| WO | 9412322 | A1 | | 6/1994 | |
| WO | 199623631 | | | 8/1996 | |
| WO | 97/29887 | | | 8/1997 | |

* cited by examiner

TOOL HOLDER FOR HOLDING MULTIPLE TOOLS OF DIFFERENT SIZES

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as alien wrenches or L-wrenches, have a hexagonal L-shaped body, including a long leg member and a short leg member. The end of either leg member is able to be inserted into a head of a screw or tool designed to accept a hexagonal wrench. Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Multiple sizes of hexagonal wrenches are often used together in order to complete a task. Consequently, it is convenient to store multiple tools of different sizes in a common location.

SUMMARY OF THE INVENTION

A tool holder holds one or more tools when not being used. The tool holder comprises one or more tool holder bodies having one or more slots for receiving a tool. In order to couple a tool with the tool holder, a tool holder body is rotated to an open position and the tool is inserted into one of the one or more slots. Then, the tool holder body is rotated back to a closed position. The tool is securely held within the tool holder body and is not removable when the tool holder body is in the closed position. In some embodiments, the tool holder is configured to hold a L-shaped hexagonal or round tool. A plurality of tool holder bodies are able to be coupled together in order to hold multiple tools of different sizes.

In one aspect, a tool holder comprises a body having one or more slots for receiving a tool and one or more supporting members for supporting a portion of the tool not received within the one or more slots. In some embodiments, the one or more slots pass through the body of the tool holder. In some embodiments, the one or more slots are different sizes. In further embodiments, the body further comprises an aperture positioned on a different side than the one or more slots. In some of these embodiments, the aperture passes through the body of the tool holder. In some embodiments, the aperture receives a rotation mechanism which enables the body to rotate with respect to one or more additional objects. In some embodiments, the tool fits within the one or more supporting members. In further embodiments, the tool holder is configured for holding a L-shaped hexagonal or round tool. In some embodiments, the tool holder holds the tool when the tool is not being used.

In another aspect, a tool holder for holding a plurality of tools comprises a plurality of tool holder bodies for receiving a tool, wherein one or more of the plurality of tool holder bodies are separately rotatable. In some embodiments, the one or more holder bodies are rotatable between an open position and a closed position, and wherein a tool is not removable from the tool holder body when the tool holder body is in the closed position. In further embodiments, the one or more additional objects are one or more additional tool holders. In some embodiments, the one or more tool holder bodies rotate about a pivot pin. In further embodiments, the one or more tool holder bodies rotate by means of a slot and a rod. In some embodiments, the one or more holder bodies comprise one or more slots for receiving a tool and one or more supporting members for supporting the tool. In some embodiments, wherein the tool fits within the one or more supporting members. In further embodiments, the one or more holder bodies are configured to hold differently sized tools. In some embodiments, the one or more holder bodies are configured for holding a L-shaped hexagonal or round tool. In some embodiments, the tool holder holds a tool when the tool is not being used.

In a further aspect, a method of removably coupling a tool with a tool holder comprises rotating one or more tool holders to an open position, inserting a tool into a slot of the one or more tool holders, and rotating the one or one or more tool holders to a closed position. In some embodiments, the tool holder is configured for holding a L-shaped hexagonal or round tool. In further embodiments, the tool is not removable when the tool holder is in the closed position.

In still a further aspect, a tool holder comprises a plurality of tool holder bodies, each having one or more slots for receiving a tool and one or more supporting members for supporting a portion of the tool not received within the one or more slots, and wherein one or more of the plurality of tool holder bodies are separately rotatable.

DETAILED DESCRIPTION OF THE PREFERRED EMBODIMENT

The description below concerns several embodiments of the invention. The discussion references the illustrated preferred embodiment. However, the scope of the present invention is not limited to either the illustrated embodiment, nor is it limited to those discussed, to the contrary, the scope should be interpreted as broadly as possible based on the language of the Claims section of this document.

This disclosure provides several embodiments of the present invention. It is contemplated that any features from any embodiment can be combined with any features from any other embodiment. In this fashion, hybrid configurations of the illustrated embodiments are well within the scope of the present invention.

Figure 1A:
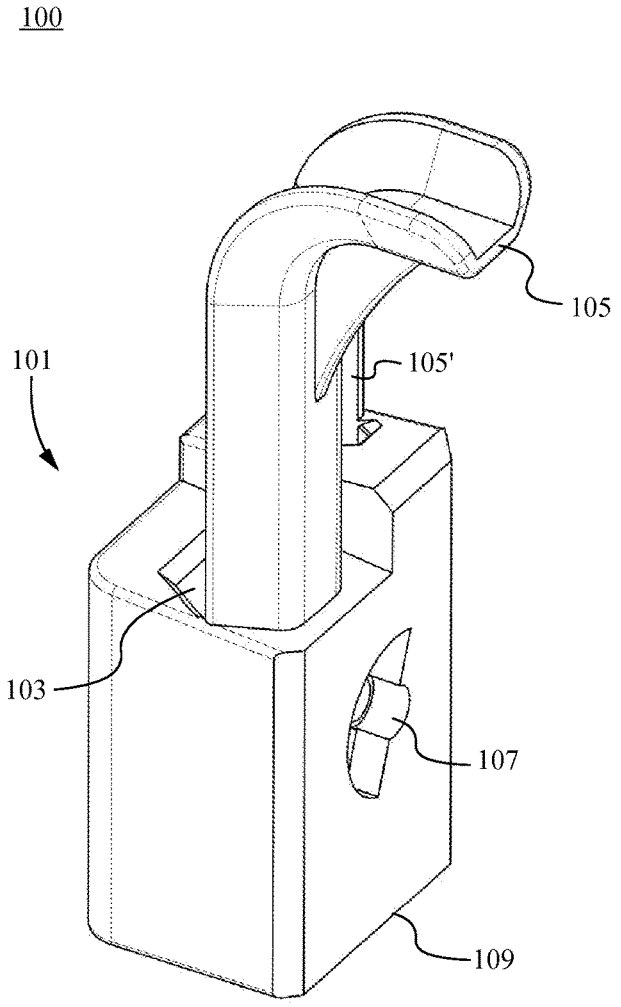
FIGS. 1A-1D illustrate a tool holder for holding a tool in accordance with some embodiments.

Referring now to FIGS. 1A-1D, a first embodiment of a tool holder is depicted therein. FIG. 1A illustrates a front perspective view of the tool holder 100 in accordance with some embodiments. The tool holder 100 comprises a body 101 having one or more slots 103 for receiving a tool, one or more supporting members 105 and 105' for supporting the tool and an aperture 107. The one or more supporting members 105 and 105' support a portion of the tool that is not received within the one or more slots 103. In some embodiments, the aperture 107 passes through the body 101. As further shown in FIG. 1A, in some embodiments a bottom 109 of the tool holder body 101 is flat.

Figure 1B:
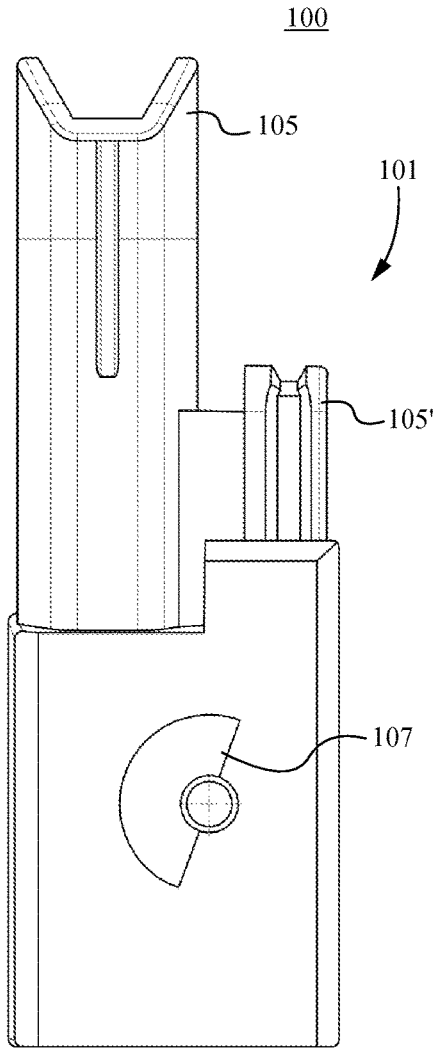
Figure 1C:
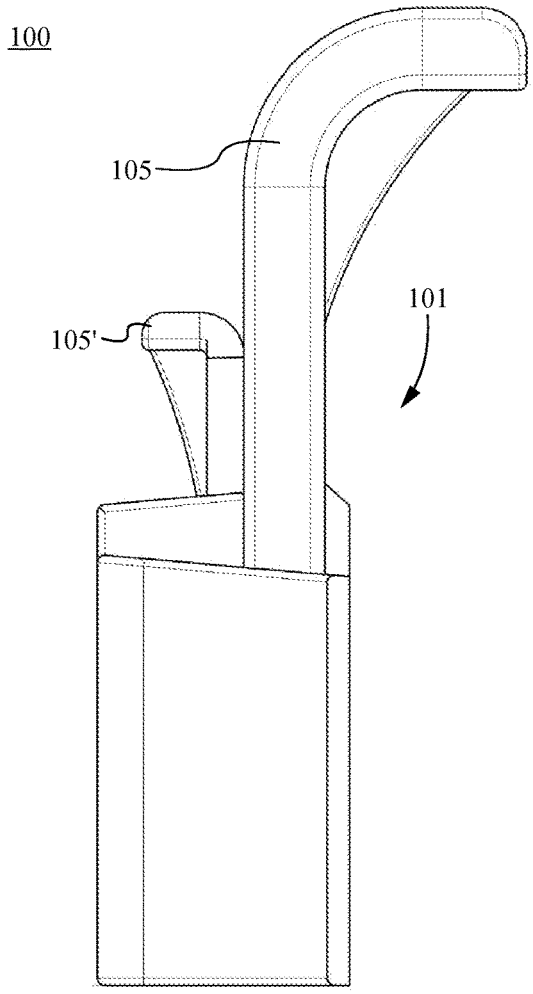

The tool holder 100 is configured for holding a L-shaped tool. The L-shaped tool is able to have any appropriate shape including hexagonal, round or any other appropriate shape. In order to removably couple a L-shaped hexagonal or round tool with the tool holder 100, the long leg of the tool is inserted into one of the one or more slots 103. When the long leg of the hexagonal or round tool is placed into one of the one or more slots 103 the short leg of the tool is held within the top of one of the one or more supporting members 105 and 105'. As shown within FIGS. 1A-1D, the one or more supporting members 105 and 105' comprise a body having a U-shaped channel When a L-shaped hexagonal or round tool is inserted into one of the one or more slots 103, the hexagonal or round tool fits securely within the bottom of the U-shaped channel FIG. 1B shows a front view of the tool holder 100 in accordance with some embodiments. As shown in the front view, the tool holder 100 comprises a body 101 having one or more supporting members 105 and 105' and an aperture 107. As described above, in some embodiments, the aperture 107 passes through the body 101. In some embodiments, the one or more supporting members 105 and 105' are different sizes. As shown in FIG. 1C, the supporting member 105 and the supporting member 105' face in different directions.

Figure 1D:
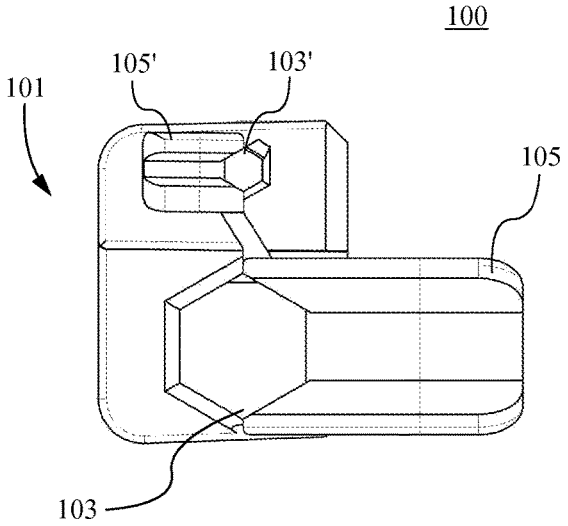

FIG. 1D illustrates a top view of the tool holder 100 in accordance with some embodiments. As shown in FIG. 1D, the tool holder 100 comprises a tool holder body 101, one or more slots 103 and 103' for receiving a tool and one or more supporting members 105 and 105'. In some embodiments, the one or more slots 103 and 103' and the one or more supporting members 105 and 105' are different sizes for receiving differently sized tools.

Figure 2:
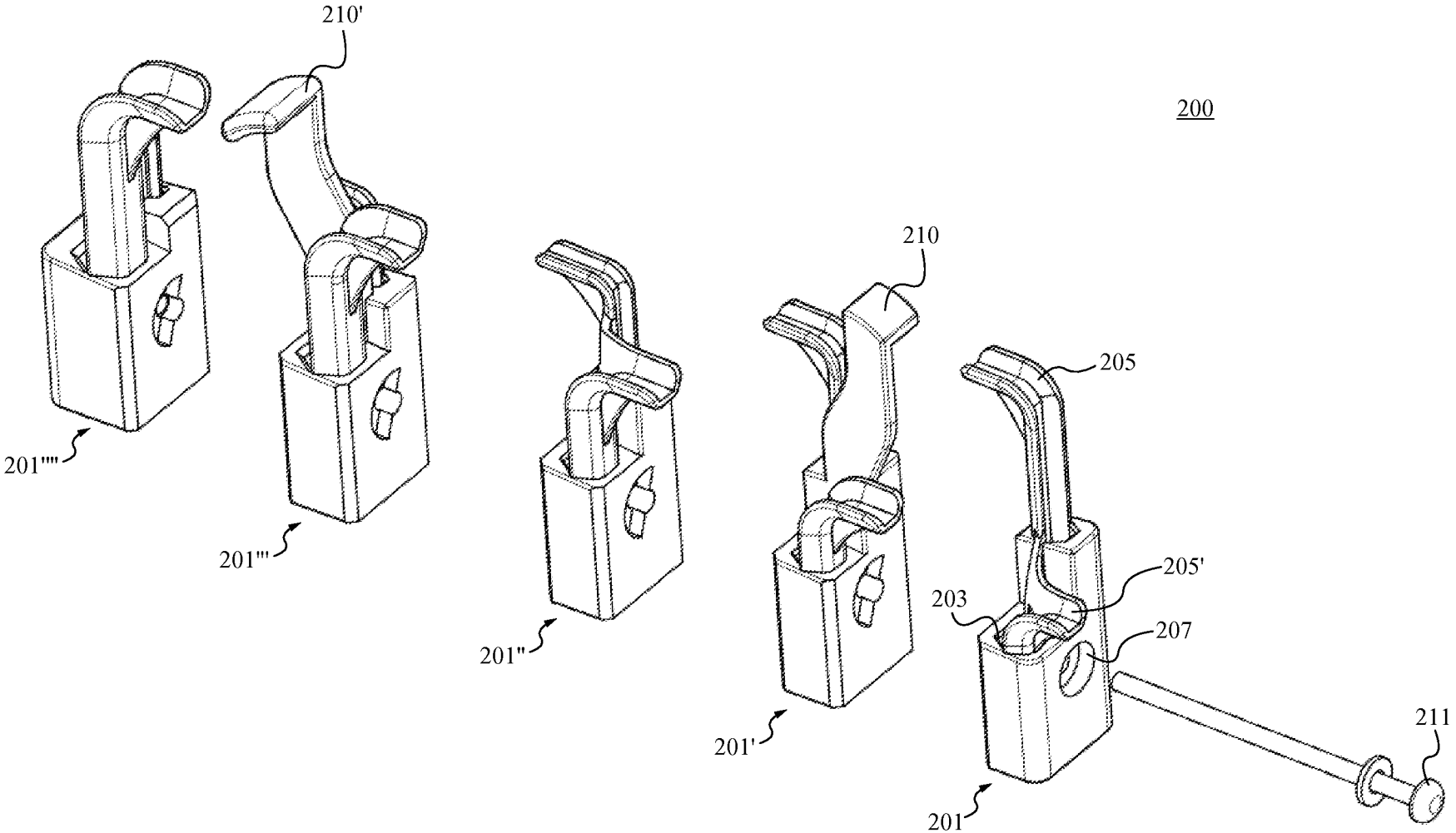
FIG. 2 illustrates an exploded view of a tool holder in accordance with some embodiments.

Referring now to FIG. 2, an exploded view of a tool holder for holding a plurality of tool is depicted therein. The tool holder 200 for holding a plurality of tools comprises one or more tool holder bodies 201, 201', 201", 201''', and 201''''. The one or more tool holder bodies 201, 201', 201", 201''', and 201'''' are similar to the tool holder body 101 as described in relation to FIGS. 1A-1D and as shown by the tool holder body 201 comprise one or more slots 203 for receiving a tool, one or more supporting members 205 and 205' and an aperture 207. In some embodiments, one or more of the one or more tool holder bodies 201, 201', 201", 201''', and 201'''' further comprise one or more securing mechanisms 210 and 210'.

As shown within FIG. 2, a pivot pin 211 is inserted into the aperture of each of the one or more tool holder bodies 201, 201', 201", 201''', and 201'''' in order to couple the one or more tool holder bodies 201, 201', 201", 201''', and 201'''' together. When the one or more tool holder bodies 201, 201', 201", 201''', and 201'''' are coupled together, each of the tool holder bodies 201, 201', 201", 201''', and 201'''' is separately rotatable. In some embodiments, the tool holder 200 further comprises a handle which a user is able to grasp in order to rotate one or more tool holder bodies 201, 201', 201", 201''', and 201''''. The one or more tool holder bodies 201, 201', 201", 201''', and 201'''' are rotatable between a closed position and an open position. In some embodiments, the supporting members of the one or more tool holder bodies 201, 201', 201", 201''', and 201'''' are configured to fit under or on top of each other when the tool holder bodies 201, 201', 201", 201''', and 201'''' are coupled together and in a closed position.

Figure 3A:
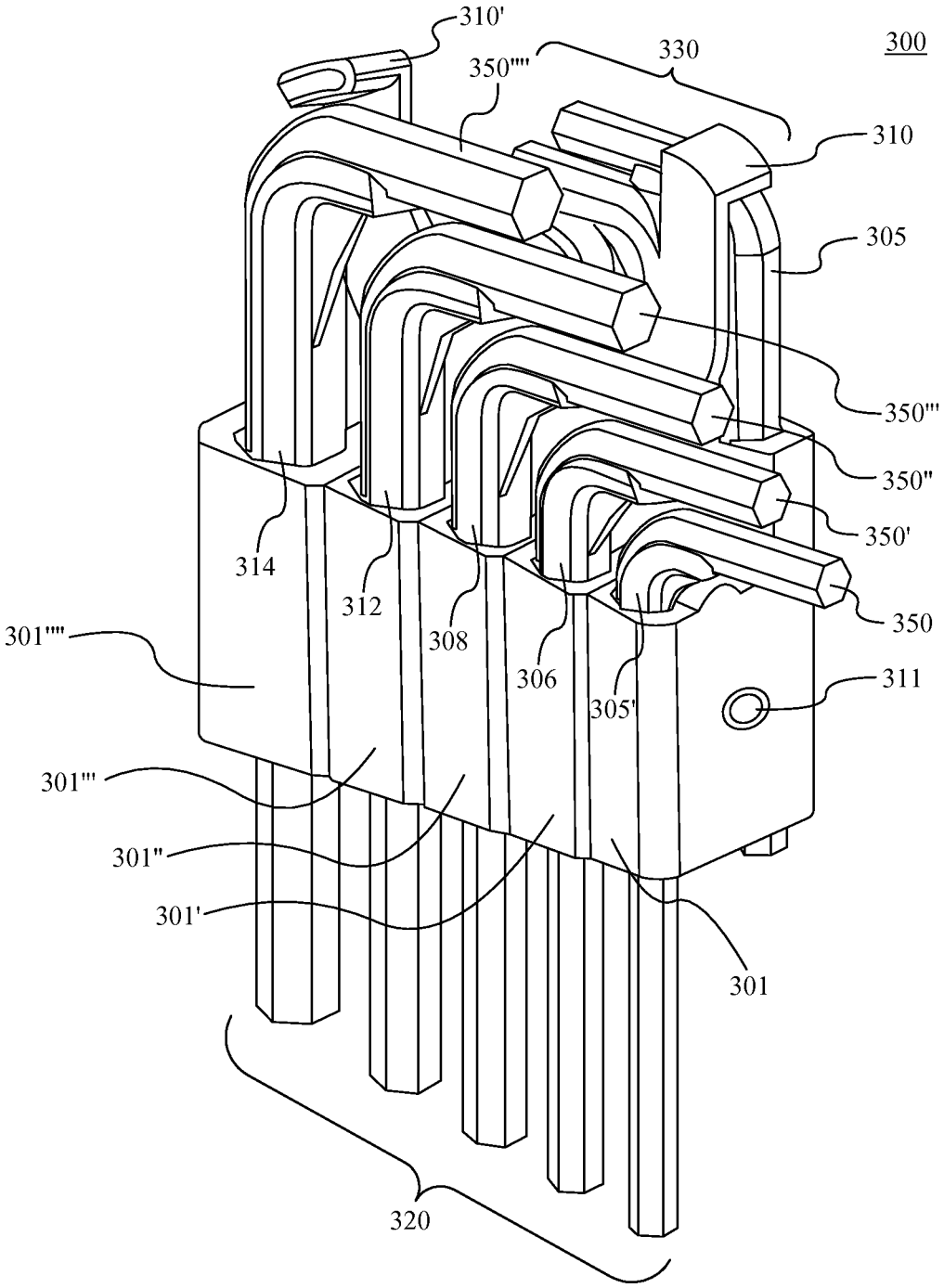
FIG. 3A illustrates a tool holder in a closed position in accordance with some embodiments.

FIG. 3A illustrates a tool holder for holding a plurality of tools in an assembled configuration. The tool holder 300 is similar to the tool holder 200 as described in relation to FIG. 2 and comprises one or more tool holder bodies 301, 301', 301", 301''', and 301'''' for holding a tool. In an assembled configuration, the one or more tool holder bodies 301, 301', 301", 301''', and 301'''' are coupled together by the pivot pin 311, which has been inserted through an aperture of the one or more tool holder bodies 301, 301', 301", 301''', and 301''''. Each of the tool holder bodies comprises one or more slots for receiving a tool, one or more supporting members for supporting the tool and an aperture. As described above, when the one or more tool holder bodies 301, 301', 301", 301''', and 301'''' are coupled together, each of the tool holder bodies 301, 301', 301", 301''', and 301'''' is separately rotatable. As further shown in FIG. 3A, in some embodiments, a first group of tool holder bodies 320 is configured in an opposite orientation to a second group of tool holder bodies 330.

FIG. 3A shows the tool holder 300 with the tool holder bodies 301, 301', 301", 301''', and 301'''' in a closed position. When the tool holder bodies 301, 301', 301", 301''', and 301'''' are in the closed position, the supporting members of the one or more tool holder bodies 301, 301', 301", 301''', and 301'''' are configured to fit under or on top of each other. As shown in FIG. 3A, one or more tools have been removably coupled with the one or more tool holder bodies. In order to couple a tool with a tool holder body, the tool is inserted into a slot of the tool holder body, as described above. When the tool holder 300 is in a closed position, the one or more tools are not removable from the tool holder 300.

When the tool holder 300 is in a closed position, the supporting member 306 covers the supporting member 305'. Particularly, in the closed position, the supporting member 306 fits over and covers the supporting member 305' and the tool 350 that is held within the supporting member 305'. Consequently, when the tool holder 300 is in the closed position, the tool 350 is not removable. As further shown in FIG. 3A, in the closed position, the supporting member 308 fits over and covers the supporting member 306 and the tool 350' that is held within the supporting member 306, the supporting member 3012 fits over and covers the supporting member 308 and the tool 350" that is held within the supporting member 308, and the supporting member 314 fits over and covers the supporting member 312 and the tool 350''' that is held within the supporting member 312. As additionally shown in FIG. 3A, the securing mechanism 310' covers the tool 350''''. Particularly, in the closed position each tool 350, 350', 350", 350''', and 350'''' is securely confined one of the tool holder bodies and is not removable. In some embodiments, the tool holder 300 further comprises a lock for locking the tool holder 300 in the closed position.

Figure 3B:
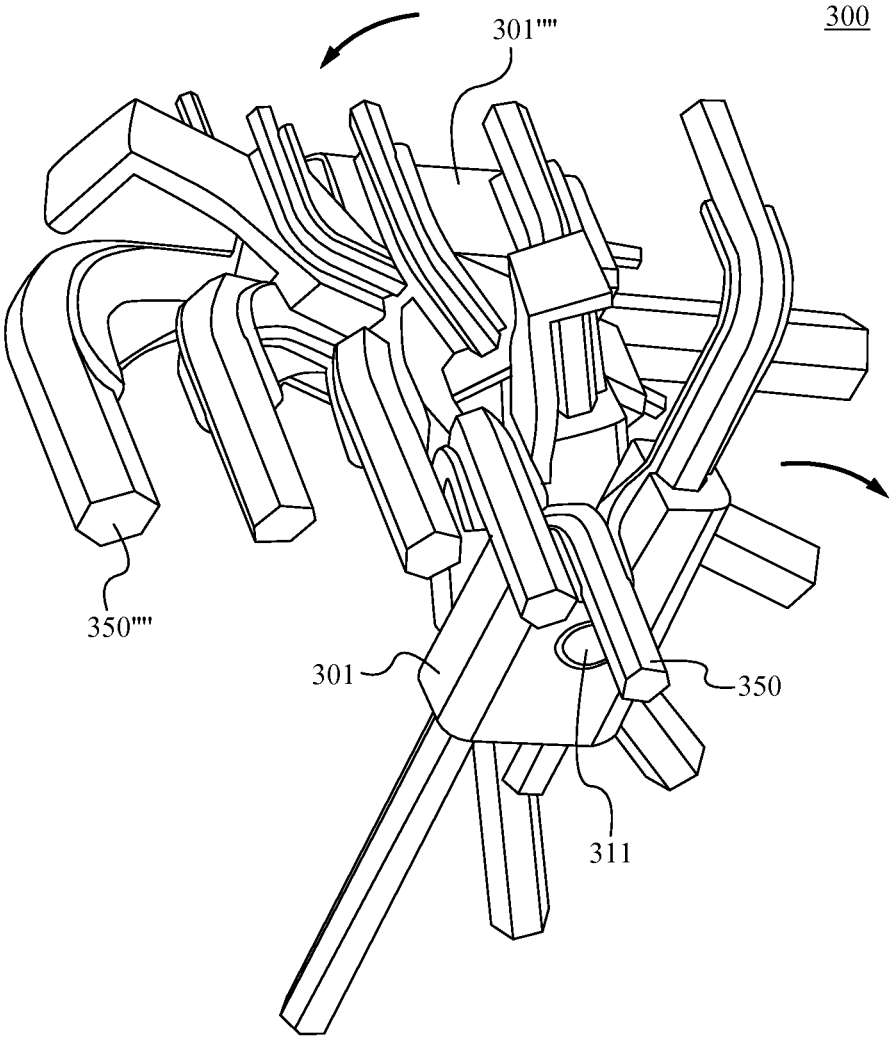
FIG. 3B illustrates a tool holder in an open position in accordance with some embodiments.

FIG. 3B shows the tool holder 300 in an open position in accordance with some embodiments. As shown in FIG. 3B when the tool holder 300 is in an open position, a tool 350 is able to be removed from the tool holder body 301. The tool holder 300 is moved to the open position by rotating one or more of the tool holder bodies in a clockwise or a counter clockwise direction. For example, in some embodiments, the tool holder body 301 is rotated in a clockwise direction as indicated by the arrow about the pivot pin 311 in order to remove the tool 350. Alternatively, the tool holder body 301"" is rotated in a counter clockwise direction as indicated by the arrow about the pivot pin 311 in order to remove the tool 350"".

Figure 4A:
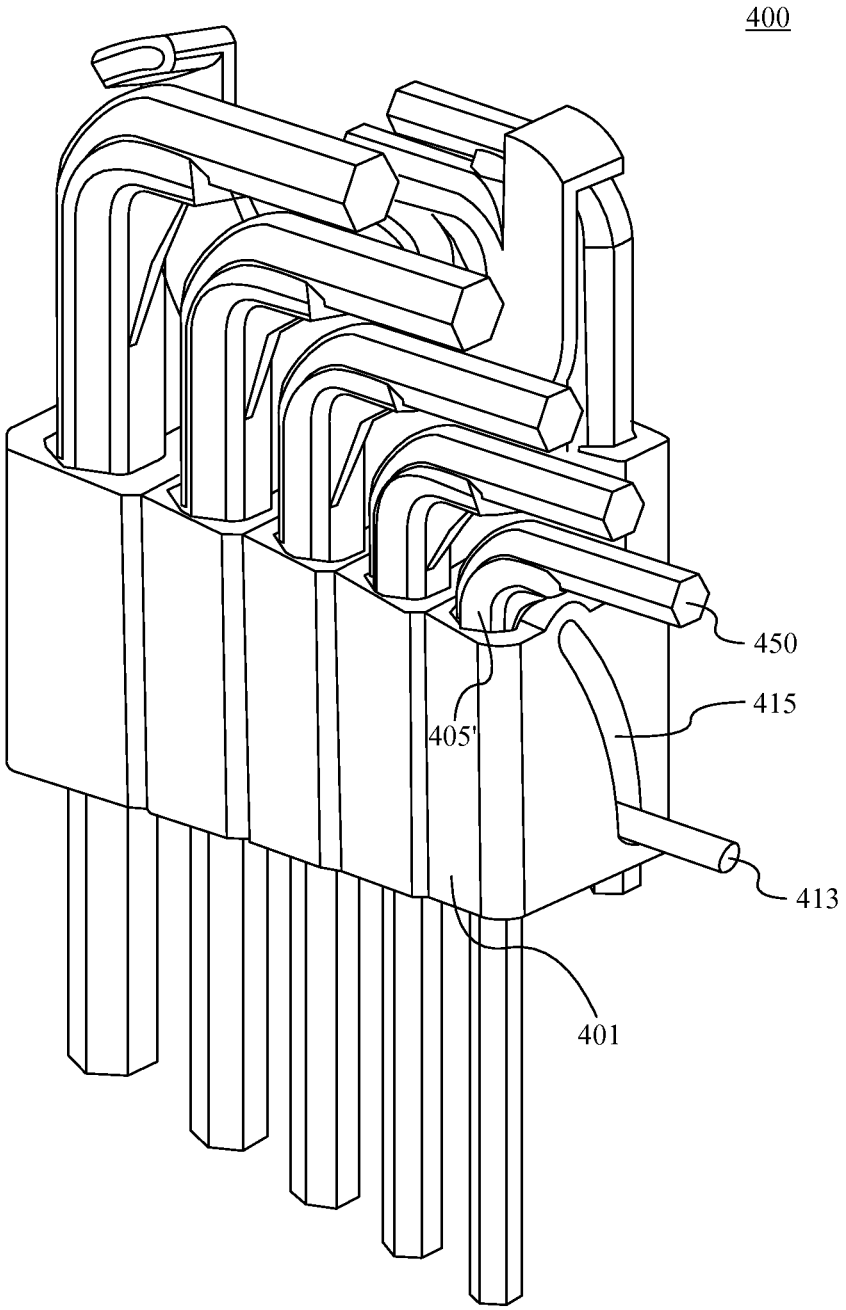
FIG. 4A illustrates a tool holder in a closed position in accordance with some embodiments.
Figure 4B:
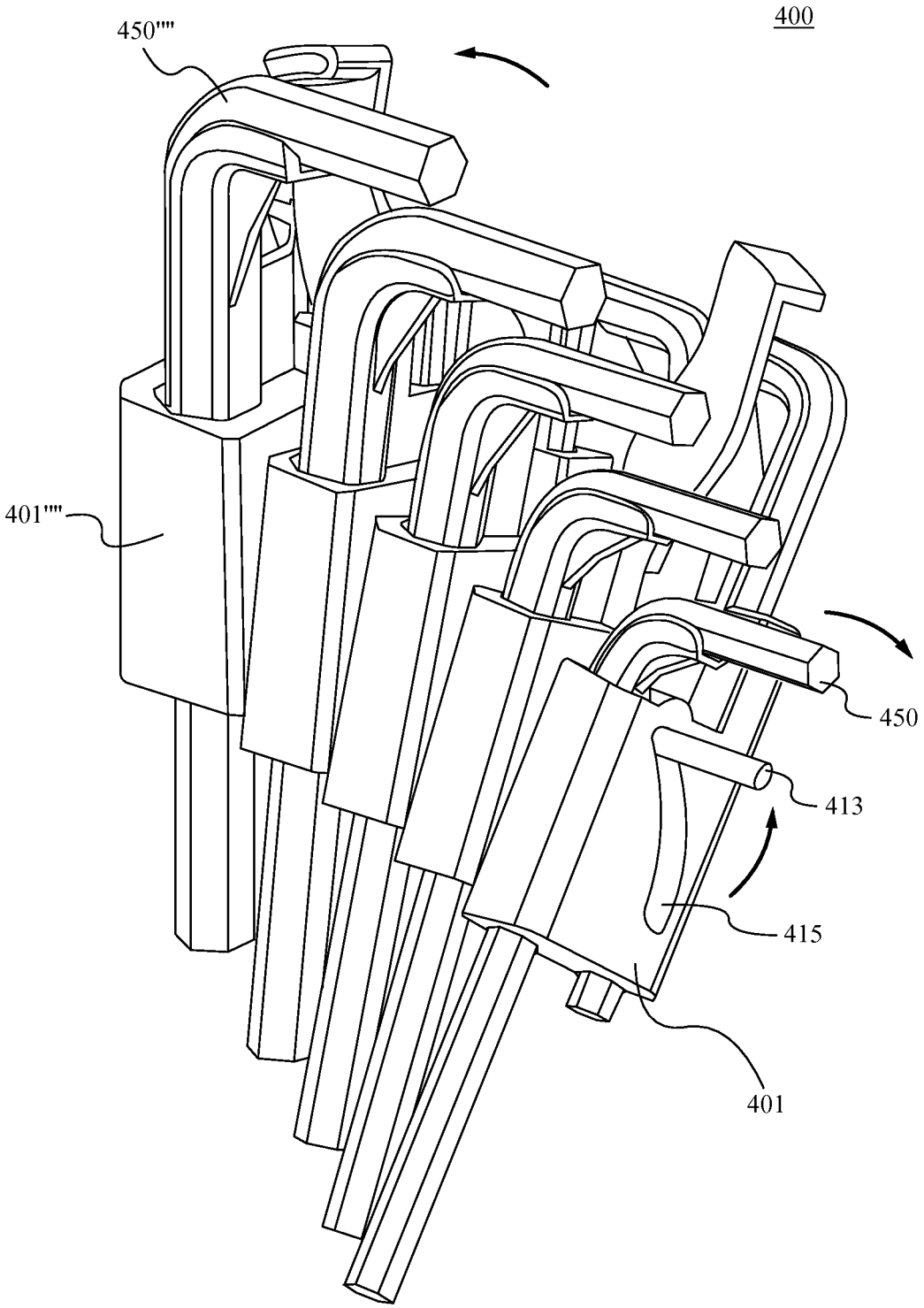
FIG. 4B illustrates a tool holder in an open position in accordance with some embodiments.

FIGS. 4A and 4B illustrate a tool holder for holding a plurality of tools in accordance with further embodiments. The tool holder 400 is similar to the tool holder 300 as described in relation to FIGS. 3A and 3B and comprises one or more tool holding bodies 401 having one or more slots for receiving a tool and one or more supporting members 405' for supporting a tool 450. As shown in FIGS. 4A and 4B, the one or more tool holder bodies 401 further comprise a slot 415 and a rod 413. The slot 415 and the rod 413 enable the one or more tool holder bodies 401 to move from a closed position to an open position when coupled together. Particularly, as shown within FIG. 4B, in some embodiments, the tool holder body 401 is rotated in a clockwise direction in order to move the tool holder to the open position and remove the tool 450. Alternatively, the tool holder body 401"" is rotated in a counter clockwise in order to remove the tool 450"". As the one or more tool holder bodies 401 are rotated between the closed position and the open position, the rod 413 moves in an upward direction and a downward direction within the slot 415.

As shown within the FIGS. 4A-4B, the tool holder rotates from a closed position to an open position by using a pivot pin and a slot an rod mechanism. However, as will be apparent to someone of ordinary skill in the art, the one or more tool holder bodies are able to rotate from a closed position to an open position be any appropriate mechanism as known in the art.

Figure 5:
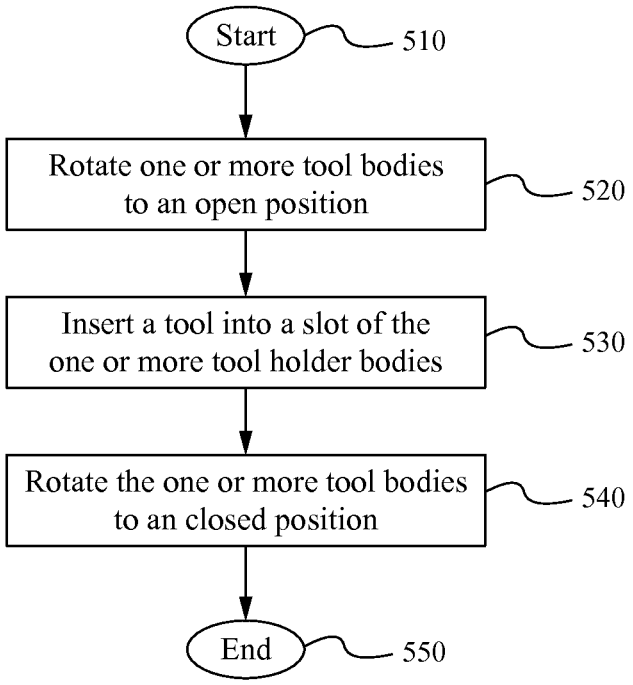
FIG. 5 illustrates a method of removably coupling a tool with a tool holder in accordance with some embodiments.

FIG. 5 illustrates a method of removably coupling a tool with a tool holder in accordance with some embodiments. In the step 520, one or more tool bodies are rotated to an open position. In the step 530, a tool is inserted into a slot of the one or more tool holder bodies. Then, in the step 540, the one or more tool holder bodies are rotated to a closed position. In some embodiments, the tool comprises a L-shaped hexagonal or round tool. In some embodiments, the tool is not removable when the tool holder is in the closed position. In some embodiments, the method further comprises locking the one or more tool holder bodies in the closed position.

In some embodiments, the tool holder for multiple tools of different sizes is designed to be utilized with hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the tool holder for multiple tools of different sizes is also designed to be utilized with hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench.

Alternatively, the tool holder for multiple tools of different sizes is able to be used with tools other than hexagonal wrenches.

The tool holder for multiple tools of different sizes is able to be composed of any appropriate material, which is of maximum strength and includes properties which resist materials that the handle will likely be exposed to, e.g., oil, grease, gasoline and the like. In some embodiments, the tool handle is materially composed of a variety of resin polymer and copolymer compositions including fillers and reinforcing materials such as glass in order to meet the strength and chemical resistance requirements of the tool. In some embodiments, the tool handle is materially composed of any suitable composition including, but not limited to aluminum or steel. In some embodiments, the tools are materially composed of aluminum, steel or any other appropriate material.

In some embodiments, the tool holder for multiple tools of different sizes is constructed using an injection molded, core/cavity process as is well known in the art. Alternatively, the tool handle is able to be constructed in any known manner.

To utilize the tool holder for multiple tools of different sizes, one or more tools are inserted into one or more slots of a tool holder body. In some embodiments, the tool is a L-shaped hexagonal or round tool. Once the tool is positioned and held within the tool holder, a user is able to easily rotate the tool holder to a closed position and easily secure to the tool within the tool holder. In this manner, one or more different sized tools are able to be easily coupled with and removed from the tool holder body and multiple sizes of tools are able to be stored together in a compact manner.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A tool holder comprising:

a. a body having a first slot for receiving a first tool, a second slot for simultaneously receiving an oppositely faced second tool, and an aperture passing through the body of the tool holder, wherein the aperture receives a rotation mechanism which couples the tool holder body to one or more additional tool holder bodies and enables the body to rotate with respect to the one or more additional tool holder bodies, wherein the body rotates between an open position and a closed position and wherein the first tool and the oppositely faced second tool are removable in the open position and not removable in the closed position; and b. a first supporting member extending above the body for supporting a portion of the first tool not received within the first slot and a second oppositely faced supporting member extending above the body for supporting a portion of the second tool not received within the second slot, wherein the first and second slots pass through the body of the tool holder.

2. The tool holder of claim 1 wherein the first and second slots are different sizes.

3. The tool holder of claim 1 wherein the aperture is positioned on a different side of the body than the first and second slots.

4. The tool holder of claim 1 wherein the tools fit within the plurality of supporting members.

5. The tool holder of claim 1 wherein the tool holder is configured for holding L-shaped hexagonal or round tools.

6. The tool holder of claim 1 wherein the tool holder holds the tools when the tool is not being used.

7. A tool holder for holding a plurality of tools comprising:

a. a plurality of tool holder bodies for receiving a tool, wherein one or more of the plurality of tool holder bodies comprise an aperture comprising a rotation mechanism for coupling the plurality of tool holder bodies together and for separately rotating about a point offset from a first end and a second end of the tool holder bodies, wherein the plurality of tool holder bodies rotate between an open position and a closed position and wherein a tool and an oppositely faced tool are removable in the open position and not removable in the closed position, each of the plurality of tool holder bodies comprising a first slot for receiving the tool and a first supporting member extending above the body for supporting a portion of the tool not received within the first slot, a second slot for simultaneously receiving the oppositely faced tool and a second supporting member extending above the body for supporting a portion of the tool not received within the first slot, wherein the first and second slots pass through each of the tool holder bodies.

8. The tool holder of claim 7 wherein the one or more holder bodies are rotatable between an open position and a closed position, and wherein a tool is not removable from the tool holder body when the tool holder body is in the closed position.

9. A tool holder for holding a plurality of tools comprising:

a plurality of tool holder bodies for receiving a tool, wherein one or more of the plurality of tool holder bodies comprise an aperture comprising a rotation mechanism for coupling the plurality of tool holder bodies together and for separately rotating about a point offset from a first end and a second end of the tool holder bodies, wherein the plurality of tool holder bodies rotate between an open position and a closed position and wherein a first tool and an oppositely faced second tool are removable in the open position and not removable in the closed position, each of the plurality of tool holder bodies comprising a first slot and a first supporting member extending above the tool holder bodies for receiving the first tool and a second slot and a second oppositely faced supporting member extending above the tool holder bodies for simultaneously receiving the oppositely faced second tool, wherein the first and second slots pass through the body of the tool holder, and wherein the plurality of holder bodies rotate about a pivot pin.

10. The tool holder of claim 7 wherein the one or more tool holder bodies rotate by means of a slot and a rod.

11. The tool holder of claim 9 wherein the tool fits within the one or more supporting members.

12. The tool holder of claim 7 wherein the one or more holder bodies are configured to hold differently sized tools.

13. The tool holder of claim 7 wherein the one or more holder bodies are configured for holding a L-shaped hexagonal or round tool.

14. The tool holder of claim 7 wherein the tool holder holds a tool when the tool is not being used.

15. A method of removably coupling a tool with a tool holder, comprising:

a. rotating one or more tool holders using a rotation mechanism received by an aperture comprising the rotation mechanism passing through the tool holder bodies and to an open position, wherein the one or more tool holders rotate with respect to one or more additional tool holders;

b. inserting a first tool into a first slot and a first supporting member of the one or more tool holders, wherein the first supporting member extends above a body of the tool holder for supporting a portion of the first tool not received within the first slot;

c. inserting a second tool into a second slot and a second oppositely faced supporting member of the one or more tool holders, wherein the second supporting member extends above the body of the tool holder for supporting a portion of the second tool not received within the first slot, wherein the first and second slots pass through the body of the tool holder; and d. rotating the one or more tool holders to a closed position.

16. The method of claim 15 wherein the tool holder is configured for holding a L-shaped hexagonal or round tool.

17. The method of claim 15 wherein the tool is not removable when the tool holder is in the closed position.

18. A tool holder comprising:

a. a plurality of tool holder bodies, each having a first slot and a first supporting member for receiving a first tool, extending above the tool holder body for supporting a portion of the first tool not received within the first slot, a second slot and a second supporting member for receiving a second oppositely faced second tool, wherein the second supporting member extends above the body of the tool holder for supporting a portion of the second tool not received within the first slot, and an aperture passing through the tool holder body, wherein the first and second slots pass through the body of the tool holder, and wherein the plurality of tool holder bodies are coupled together by a rotation mechanism and are separately rotatable about the rotation mechanism received by the aperture, wherein the plurality of tool holder bodies rotate between an open position and a closed position and wherein the first tool and the oppositely faced second tool are removable in the open position and not removable in the closed position.

19. A tool holder comprising:

a. a first body having a first slot for receiving a first tool and a first supporting member for supporting a portion of the first tool not received within the first slot and a second slot for receiving a second tool and a fourth supporting member for supporting a portion of the second tool not received within the second slot, wherein the second tool and the second supporting member oppositely face the first tool and the first supporting member, wherein the first and second slots pass through the body of the tool holder;

b. a second body having a third slot for receiving a third tool and a third supporting member for supporting a portion of the third tool not received within the third slot and a fourth slot for receiving a fourth tool and a fourth supporting member for supporting a portion of the fourth tool not received within the fourth slot wherein the fourth tool and the fourth supporting member oppositely face the third tool and the third supporting member, wherein the fourth tool is held in an oppositely facing orientation from the third tool; and c. a supporting rod coupled to the first body and the second body for coupling the first body to the second body and allowing the first body and the second body to rotate about the supporting rod, wherein the supporting rod is received by an aperture that passes through the first body and the second body, wherein the aperture receives a rotation mechanism which enables the first body and the second body to rotate with respect to one another, wherein the first body and the second body rotate between an open position and a closed position and wherein the first tool, the second tool, the third tool and the fourth tool are removable in the open position and not removable in the closed position.

* * * * *